US008865277B2

(12) United States Patent
Zhou et al.

(10) Patent No.: US 8,865,277 B2
(45) Date of Patent: Oct. 21, 2014

(54) INKJET MEDIA

(75) Inventors: Xiaoqi Zhou, San Diego, CA (US); Xulong Fu, San Diego, CA (US); David Edmondson, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/004,636

(22) PCT Filed: Mar. 29, 2011

(86) PCT No.: PCT/US2011/030351

§ 371 (c)(1),
(2), (4) Date: Sep. 11, 2013

(87) PCT Pub. No.: WO2012/134455

PCT Pub. Date: Oct. 4, 2012

(65) Prior Publication Data

US 2014/0010975 A1 Jan. 9, 2014

(51) Int. Cl.

| | |
|---|---|
| ***B41M 5/00*** | (2006.01) |
| ***D21H 11/00*** | (2006.01) |
| ***D21H 13/02*** | (2006.01) |
| ***D21H 13/10*** | (2006.01) |
| ***D21H 19/36*** | (2006.01) |
| ***D21H 19/44*** | (2006.01) |
| ***D21H 11/14*** | (2006.01) |
| ***B41M 5/50*** | (2006.01) |
| *B41M 5/52* | (2006.01) |

(52) U.S. Cl.

CPC ..... *B14M 5/508* (2013.01); *D21H 11/00* (2013.01); *D21H 13/02* (2013.01); *D21H 13/10* (2013.01); *D21H 19/36* (2013.01); *D21H 19/44* (2013.01); *D21H 11/14* (2013.01); *B41M 5/504* (2013.01); *B41M 5/506* (2013.01); *B41M 5/5218* (2013.01); *B41M 2205/34* (2013.01); *B41M 2205/36* (2013.01); *B41M 2205/38* (2013.01)

USPC ..... 428/32.21; 428/32.34; 428/32.35; 162/135; 162/141; 162/149; 162/231

(58) Field of Classification Search

CPC ..... B41M 5/504; B41M 5/506; B41M 5/508; B41M 5/5218; B41M 5/52; B41M 5/5254; B41M 5/502; D21H 13/02; D21H 13/10; D21H 11/00; D21H 11/14; D21H 19/36; D21H 19/44

USPC ..... 428/32.21, 32.34, 32.35; 162/135, 141, 162/149, 231

See application file for complete search history.

(56) References Cited

U.S. PATENT DOCUMENTS

| | | | |
|---|---|---|---|
| 2,971,877 | A | 2/1961 | Arledter |
| 4,140,566 | A | 2/1979 | Burton et al. |

(Continued)

FOREIGN PATENT DOCUMENTS

| | | | |
|---|---|---|---|
| CN | 1315906 | | 10/2001 |
| CN | 1582234 | | 2/2005 |
| CN | 1819927 | | 8/2006 |
| CN | 1822959 | | 8/2006 |
| CN | 101346241 | | 1/2009 |
| CN | 101365761 | | 2/2009 |
| JP | 9183265 | | 7/1997 |
| JP | 2001303491 | A | 10/2001 |
| WO | WO-96/20091 | A1 | 7/1996 |
| WO | WO-0006392 | A1 | 2/2000 |
| WO | WO-03037641 | A3 | 10/2003 |
| WO | WO-2006/049729 | A1 | 5/2006 |
| WO | WO-2006/083032 | A1 | 8/2006 |
| WO | WO-2009/082000 | A1 | 7/2009 |

*Primary Examiner* — Betelhem Shewareged

(57) ABSTRACT

In one example, an inkjet media includes a substrate layer with cellulose fibers, synthetic fibers, and a polymeric binder. A barrier layer is disposed on at least one side of the substrate layer, the barrier layer including pigment fillers and at least 30 percent by weight of a polymer resin.

17 Claims, 3 Drawing Sheets

(56) References Cited

U.S. PATENT DOCUMENTS

| | | | | |
|---|---|---|---|---|
| 4,908,345 | A | 3/1990 | Egashira et al. | |
| 5,543,207 | A | 8/1996 | Heighington et al. | |
| 5,647,935 | A | 7/1997 | Hoshino et al. | |
| 6,096,469 | A * | 8/2000 | Anderson et al. | 427/256 |
| 6,440,269 | B1 | 8/2002 | Freeburn | |
| 6,913,801 | B2 | 7/2005 | Kim et al. | |
| 6,936,315 | B2 | 8/2005 | Onishi et al. | |
| 7,374,800 | B2 | 5/2008 | Burch et al. | |
| 2002/0119274 | A1 * | 8/2002 | Yang et al. | 428/40.1 |
| 2005/0008795 | A1 | 1/2005 | Dungworth et al. | |
| 2005/0032644 | A1 | 2/2005 | Brelsford et al. | |
| 2005/0032931 | A1 | 2/2005 | Naisby et al. | |
| 2006/0093762 | A1 | 5/2006 | Niekamp et al. | |
| 2006/0222789 | A1 | 10/2006 | Dontula et al. | |
| 2007/0012413 | A1 | 1/2007 | Braun et al. | |
| 2007/0218254 | A1 * | 9/2007 | Zhou et al. | 428/195.1 |
| 2007/0287345 | A1 | 12/2007 | Confalone et al. | |

* cited by examiner

INKJET MEDIA

BACKGROUND

Inkjet printing can create images on a wide variety of media. These media can be traditional cut sized sheets and commercial large format media such as banners and wall papers. Many inkjet inks are water-based with water soluble dyes or water dispersible pigments. When the inkjet inks or other fluids contact cellulose based media, the media can undesirably expand, warp, or wrinkle due to absorption of the fluid by the cellulose fibers. This expansion can be particularly undesirable in large format media such as banners and wall papers. Warped banners may be difficult to install on a panel, frame or surface. Warped wall papers do not match adjoining sheets, causing a discontinuity in the wall paper image.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Inkjet printing can create images on a wide variety of media. These media can be traditional cut sized sheets and commercial large format media such as banners and wall papers. Many inkjet inks are water-based with water soluble dyes or water dispersible pigments. When the inkjet inks or other fluids contact cellulose based media, the media can undesirably expand, warp, or wrinkle due to absorption of the solution by the cellulose.

Expansion or warping of wall papers and large format media intended for signage can be particularly undesirable. Wall papers and other large format media are often exposed to high moisture environments. For example, banners may be exposed high humidity and high heat. Wall papers may be immersed in water to activate an adhesive backing. The large dimensions of the large format media can magnify the effects of even relatively low percentages of expansion. For example, an expansion of 2% may not be noticeable on an 8.5×11 inch sheet for desk-top printing. However, a 2% expansion of a 1 meter wide banner results a change in the width of the banner by 2 centimeters. This can result in a noticeable gap or overlap between the banner and surrounding items. As discussed above, warped banners may be difficult to install into a panel, frame or surface. Warped wall papers do not match adjoining sheets, causing a discontinuity in the wall paper image.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of approximately 1 wt % to about 20 wt % should be interpreted to include not only the explicitly recited concentration limits of 1 wt % to about 20 wt %, but also to include individual concentrations such as 2 wt %, 3 wt %, 4 wt %, and sub-ranges such as 5 wt % to 15 wt %, 10 wt % to 20 wt %, etc.

Figure 1:
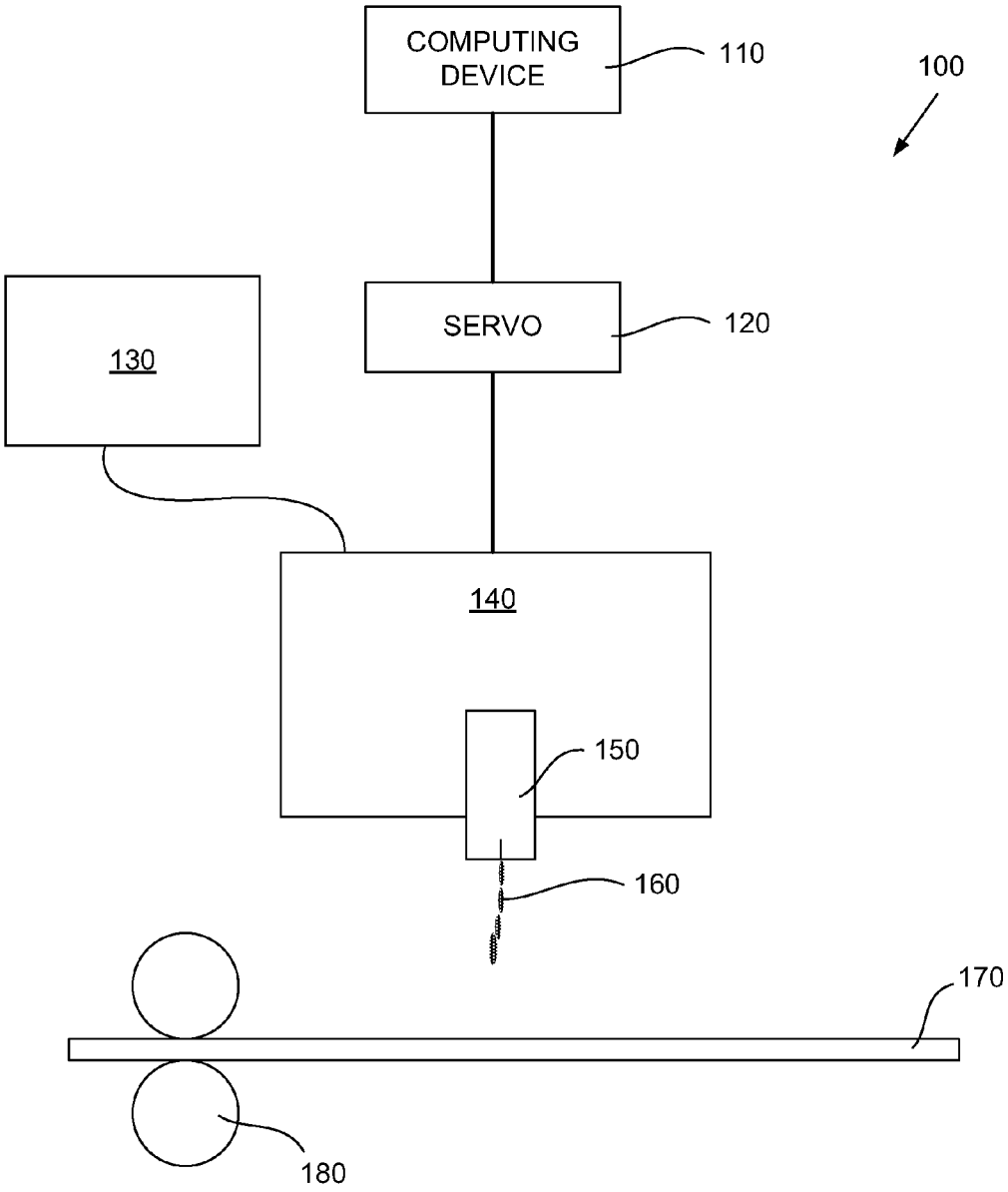
FIG. 1 is a diagram of one illustrative inkjet material dispensing system, according to one example of principles described herein.

FIG. 1 illustrates an illustrative inkjet system (100) that may be used to apply a pigment-based inkjet ink (160) to an inkjet medium (170). As shown in FIG. 1, the present system includes a computing device (110) controllably coupled through a servo mechanism (120) to a moveable carriage (140) having an inkjet print head (150) disposed thereon. An ink reservoir (130) is coupled to the inkjet print head (150) through the moveable carriage (140). A number of rollers (180) are located adjacent to the inkjet dispenser (150) and selectively position an inkjet medium (170). The above-mentioned components of the system (100) will now be described in further detail below.

The computing device (110) is controllably coupled to the servo mechanism (120), as shown in FIG. 1, controls the selective deposition of an inkjet ink (160) on an inkjet medium (170). A representation of a desired image or text may be formed using a program hosted by the computing device (110). That representation may then be converted into servo instructions that control the servo mechanisms (120) as well as the movable carriage (140) and inkjet dispenser (150). The computing device (110) illustrated in FIG. 1 may be, but is in no way limited to, a workstation, a personal computer, a laptop, a digital camera, a personal digital assistant (PDA), or any other processor containing device.

The moveable carriage (140) of the present printing system (100) illustrated in FIG. 1 is a moveable material dispenser that may include any number of inkjet material dispensers (150) configured to dispense the inkjet ink (160). The moveable carriage (140) may be controlled by a computing device (110) and may be controllably moved by, for example, a shaft system, a belt system, a chain system, etc. making up the servo mechanism (120). As the moveable carriage (140) operates, the computing device (110) may inform a user of operating conditions as well as provide the user with a user interface.

As an image or text is printed on the inkjet medium (170), the computing device (110) may controllably position the moveable carriage (140) and direct one or more of the inkjet dispensers (150) to selectively dispense an inkjet ink at predetermined locations on the inkjet medium (170) as digitally addressed drops, thereby forming the desired image or text. The inkjet material dispensers (150) used by the present printing system (100) may be any type of inkjet dispenser configured to perform the present method including, but in no way limited to, thermally actuated inkjet dispensers, mechanically actuated inkjet dispensers, electrostatically actuated inkjet dispensers, magnetically actuated dispensers, piezoelectrically actuated dispensers, continuous inkjet dispensers, etc. Additionally, the present inkjet medium (170) may receive inks from non-inkjet sources such as, but in no way limited to, screen printing, stamping, pressing, gravure printing, and the like.

The ink reservoir (130) is fluidly coupled to the inkjet material dispenser (150) houses and supplies an inkjet ink (160) to the inkjet material dispenser. The ink reservoir (130) may be any container configured to hermetically seal the pigment-based inkjet ink (160) prior to printing.

FIG. 1 also illustrates the components of the present system that facilitate reception of the pigment-based inkjet ink (160) onto the inkjet medium (170). As shown in FIG. 1, a number of positioning rollers (180) may transport and/or positionally secure an inkjet medium (170) during a printing operation. Alternatively, any number of belts, rollers, substrates, or other transport devices may be used to transport and/or postionally secure the inkjet medium (170) during a printing operation.

The illustrative inkjet media described below have increased water resistance, dimensional stability and enhanced image quality. In general, the illustrative inkjet media includes a media substrate, barrier layers, and an image receiving layer. In some examples, the illustrative inkjet media may include a water active adhesive layer or a pressure sensitive adhesive layer.

Media Substrate

The media substrate is a base layer which provides mechanical strength to the media and provides surfaces on which coatings can be formed. In one example, the media substrate includes both cellulose fibers and synthetic fibers. The cellulose fibers can be made from hardwood or softwood species and may have an average fiber length between 0.5 to 3 mm. The ratio of hardwood to softwood fibers can range from 100:0 down to 50:50. In one example, the hardwood to softwood fiber ratio is approximately 70:30 by weight. Cellulose fibers have a number of advantages, including low cost, ready availability, good bonding characteristics, and good processing characteristics during substrate manufacturing. However, raw cellulose fibers readily absorb fluids. When cellulose fibers absorb a significant amount of liquid, they may exhibit a loss of strength, stiffness, and reduced dimensional stability.

The synthetic fibers are made by polymerization of organic monomers. The synthetic fibers include fibers formed from polyolefins, polyamides, polyesters, polyurethanes, polycarbonates and polyacrylics. For example, synthetic polyolefin fibers such as polyethylene fibers, polyethylene copolymers fibers, polypropylene and propylene copolymer fibers may be included in the media substrate. Synthetic fibers may improve a number of characteristics of the media substrate, such as the water resistance and dimensional stability.

In some cases, synthetic fiber received at the paper mill may have lengths which are longer than optimal for processing on a conventional paper machine. For example, the synthetic fiber as received may be 5-10 mm in length, which can be difficult to longitudinally and transversely orient on the screen of the paper mill. The synthetic fibers can be shortened to 1-3 mm by a refining process in the paper mill. This length is comparable to the length of cellulose fibers. In some implementations, it may be desirable to use synthetic fibers with a greater length as long as the synthetic fibers do not negatively impact the formation of the media substrate on the screen of the paper mill. In one example, the synthetic fiber has diameter of 10-40 micrometers with length of 2-3 mm. The amount of the synthetic fiber used in the substrate depends on the length of the fiber. The use of longer synthetic fibers allows for improvements in the dimensional stability of the media with lower amounts of synthetic fibers. In general the cost of synthetic fibers is higher than cellulose fibers. To determine an optimum base substrate formulation, a number of factors can be considered and balanced, including material cost, machine processibility of the selected fibers, and the end use of the substrate. In one example, 5 to 65 parts by weight of synthetic fiber for 100 parts of natural fiber can be included in the substrate layer. When selecting synthetic fibers, additional properties of the synthetic fibers can also be taken into account to produce a media substrate with the desired characteristics. For example, melting point and glass transition temperatures of the synthetic fibers can influence the characteristics of the media substrate. If the melting point and glass transition temperature of the synthetic fibers are too low, the synthetic fibers may have low stiffness and the substrate may not have the desired rigidity. If the synthetic fibers have a glass transition temperature and a melting point which are too high, there may be other difficulties in processing the fibers and the media substrate. In one illustrative implementation, the synthetic fibers may have a crystalline structure with melting point range of approximately 100-140° C.

A number of additional additives may be included in the substrate layer to make to synthetic fibers more compatible with cellulose fibers. A polymeric binder or a mixture of polymeric binders can be added to the substrate. In one implementation, 0.1 to 30% of polymeric binder (by weight of the total fibers) may be added to the substrate. For example, 5-10% polymeric binder or mixture of binders may be added. Binders include water soluble polymers such as polyvinyl alcohol, starch derivatives, gelatin, cellulose derivatives, acrylamide polymers, and water-dispersible polymers such as acrylic polymers or copolymers, vinyl acetate latex, polyesters, vinylidene chloride latex, and styrene-butadiene or acrylonitrile-butadiene copolymer latex. The binders can be premixed with the fiber. Aqueous coupling agents may also be used to improve binding between the fibers.

Some synthetic fibers, such as polyolefin fibers have a non-polar and high crystalline surface structure which can result in segregation of synthetic fibers from cellulose fibers. Examples of polyolefin fibers include polyethylene fibers, polyethylene copolymer fibers, polypropylene fibers, and polypropylene copolymer fibers. The segregation of the synthetic fibers can produce a media with poor formation and mechanical strength. To overcome these challenges, the synthetic fibers can be pre-treated in corona chamber at room temperature and atmosphere. During the corona treatment, polar groups such as hydroxyl, ketone and carboxyl groups can be grafted onto the fibers. In another implementation, the synthetic fibers can be pre-washed with a $H_2SO_4$ solution of 30-50% concentration by weight to "oxidize" and "etch" the surface to improve its hydrophilicity. To improve the opacity of the base substrate and reduce cost, inorganic fillers like calcium carbonates and TiO2 may also be compounded with natural and synthetic fibers. In one example, up to 25% of the total weight of the substrate may be inorganic fillers.

As discussed above, synthetic fibers are more expensive than cellulose fibers. Consequently, it can be desirable to use a minimum amount of synthetic fibers to achieve the desired media characteristics. In order to reduce the synthetic fiber amount, a moisture repelling agent, up to 5% of total fiber weight can be used. In one example, the moisture repelling agent may be a polyolefin wax based latex. Examples of the polyolefin wax based latex are the latex made by Michelman Inc, Cincinati, USA under the trade name Michem® Lube and Michem® Emulsion. The moisture repelling agent reduces the uptake of moisture by the cellulose fibers. Consequently, less synthetic fiber is needed to maintain the dimensional stability of the media.

Barrier Layer

Barrier layers may be deposited on at least one side of the substrate. The barrier layers are resin-rich pigment coating layers that reduce the penetration of exterior moisture into the substrate. The barrier layers include one or more types of pigment particles and polymer resin binder. The term "resin-rich" refers to compositions in which larger proportions of polymer resin components are included than are needed to bind the pigment particles to each other and the barrier layer to the underlying substrate, which is normally in the range of 5-20% by weight of total coating amount. For example, a resin-rich barrier layer may include polymer resins in amounts that are at least 30% by weight of the total pigment fillers. In one example, the barrier layer includes 60 to 80% resins by total weight of barrier layer. The polymer resins act both to hold the pigments together and as a moisture barrier that prevents moisture absorption from environment. This enhances the dimensional stability of the inkjet media. There are a wide variety of resin compositions which can be used in the barrier layer. For example, the resin compositions may include, but are not limited to, resins formed by polymerization of hydrophobic addition monomers. Examples of hydrophobic addition monomers include, but are not limited to, C1-C12 alkyl acrylate and methacrylate (e.g., methyl acrylate, ethyl acrylate, n-propyl acrylate, isopropyl acrylate, n-butyl acrylate, isobutyl acrylate, sec-butyl acrylate, tert-butyl acrylate, 2-ethylhexyl acrylate, octyl arylate, methyl methacrylate, ethyl methacrylate, n-propyl methacrylate, isopropyl methacrylate, n-butyl methacrylate, isobutyl methacrylate, sec-butyl methacrylate, tert-butyl methacrylate), and aromatic monomers (e.g., styrene, phenyl methacrylate, o-tolyl methacrylate, m-tolyl methacrylate, p-tolyl methacrylate, benzyl methacrylate), hydroxyl containing monomers (e.g., hydroxyethylacrylate, hydroxyethylmthacrylate), carboxylica containing monomers (e.g., acrylic acid, methacrylic acid), vinyl ester monomers (e.g., vinyl acetate, vinyl propionate, vinylbenzoate, vinylpivalate, vinyl-2-ethylhexanoate, vinylversatate), vinyl benzene monomer, C1-C12 alkyl acrylamide and methacrylamide (e.g., t-butyl acrylamide, sec-butyl acrylamide, N,N-dimethylacrylamide), crosslinking monomers (e.g., divinyl benzene, ethyleneglycoldimethacrylate, bis(acryloylamido)methylene), and combinations thereof. In particular, polymers made from the polymerization and/or copolymerization of alkyl acrylate, alkyl methacrylate, vinyl esters, and styrene derivatives may be useful. The polymers can be made using a wide variety of polymerization methods. For example, the polymers may be made using bulk polymerization, solution polymerization, emulsion polymerization, or other suitable methods. In one implementation, the emulsion polymerization in the presence of aqueous solvent such as water may be useful in making the polymer resins described above. In one example, the polymer latex resin was made using emulsion polymerization with a particle size ranging from 0.1 to 5 micrometers. The range of particles sizes can be narrower in some implementations. For example, the particle size may range from 0.5 to 3 micrometers and in one implementation, the average particles size of latex resin was 1.2 micrometers.

The glass transition temperature, Tg, of polymer resin can be another factor that influences the desired performance. In one implementation, the glass transition temperature of the polymer resin ranges from 20 to 50 C.

To improve the binding capability and latex stability of acrylic polymer resins, a carboxylic acid monomer or combination of carboxylic acid monomers can be copolymerized onto the polymer resin chain. The examples of carboxylic acid monomers include, but not limited to, acrylic acid, methacrylic acid, and itaconic acid. The effectiveness of the carboxylic acid unit is dependent upon the molecular structure and can be characterized by a neutralization number which is defined as the mass of potassium hydroxide (KOH) in milligrams that is required to neutralize one gram of polymer resin. In general, the higher the neutralization number, the higher the hydrophilicity. Most polymer binders used in paper coatings have neutralization values over 150 milligrams per gram To produce the superior moisture resistance in the barrier layer, the neutralization value of the polymer resin can be significantly lower than 150 milligrams per gram. For example, neutralization value of the polymer resin may be between approximately 20-70 milligrams per gram.

Inorganic pigments can also be present in barrier coating layer composition. In one implementation, the inorganic pigments in the barrier coating layers can have a mean size from 0.2 micrometers to 1.5 micrometers These inorganic pigments can be in a powder or slurry form, and examples include, but are not limited to, titanium dioxide, hydrated alumina, calcium carbonate, barium sulfate, silica, clays (such as high brightness kaolin clays), and zinc oxide. In one implementation, calcium carbonate may be used. Calcium carbonate has a number of desirable properties including high brightness, gloss, opacity, good rheology, and good coating ability. Additionally, calcium carbonate is relatively economical to obtain.

In one implementation, the barrier layers are deposited on both sides of the substrate. The coat weight of barrier layer ranges from 0.01 to 10 grams per square meter. For example, the coat weight of the barrier layer may be from 1 to 5 grams per square meter. The use of these barrier layers may have a number of advantages including improved surface smoothness, lower cost, lower material consumption and better recyclability than other approaches such as resin saturation of the substrate layer.

Image Receiving Layer

An image receiving layer is formed over at least one of the barrier layers. In situations where the media will only be viewed from one side (the "image side"), the image receiving layer is formed only on that side. The image receiving layer may be the outermost layer or may have one or more overlying coatings. The function of the image receiving layer is to receive the inkjet ink, absorb the ink carrier fluid and stabilize the colorant in the ink.

In one illustrative implementation, the image receiving layer may include one or more of several types of pigments and a polymeric binder. The first type of pigment, Pigment A, is selected to produce a porous and smooth coating layer that provides desirable physical properties of a printing media such as opacity, whiteness and brightness. This pigment is structurally non-porous but it can create a porous structure due to its packing geometry. For example, Pigment A may have a non-spherical morphology. The non-spherical morphology can be measured using an aspect ratio defined as the fraction of average length to average width of the particles. According to one implementation, the average aspect ratio of Pigment A particles is between approximately 25 and 300. For example, the aspect ratio may have a range between approximately 70 and 180. Particles with these aspect ratios may have a needle-like geometry. The packing density of these needle-like pigments is determined by the degree of "needle" separation. Pigments with a higher aspect ratio have a greater irregularity and a looser packing structure with greater needle separation. These loosely packed structures can significantly increase ink absorption without sacrificing other physical property such as brightness, whiteness, gloss and opacity.

The second type of pigment, Pigment B, further enhances the capacity for absorption of the ink carrier fluid and improves the processing ability of Pigment A. Pigment B is selected from inorganic fillers with a spherical or spherical-like morphology and is structurally porous. For example, pigment B may be structured kaolin clay that is formed by subjecting hydrous clays to calcinations at an elevated temperature or by chemical treatments. Another example of particles that may be included in Pigment B is reaction products of clay grafted with colloidal silica.

The third type of inorganic particle, Pigment C, is selected from the particles having sponge-like structures with controlled porosity. Pigment C is used to improve the durability of image formed by an aqueous ink and also further improves ink absorption of an image receiving layer that includes Pigment A and Pigment B. In general, the sponge-like structure of Pigment C can be formed from aggregation of non-porous sub-micrometer particles that form a secondary porous structure or by using materials with a sponge-like morphology. The particles may be based on the chemical compounds of, for example but not limited to, zeolite, alumnia and silica with such a sponge-like structure can be used as the Pigments C, although any another suitable material capable of functioning similarly to those materials could be used. It can be desirable for manufacturing and deposition of the image receiving layer for the non-porous sub-micrometer particles to be dispersible in the same slurry as Pigment A and Pigment B. For example, certain classes of silica gel made from the acidification of sodium silicate solution via precipitation and de-hydrolyzation can be used as Pigments C. These particles can serve a number of purposes beyond their intrinsic capability to absorb liquids contained in the inkjet ink. Without being limited by any theory, these particles are believed to serve as spacers in a coating structure which includes Pigment A and Pigment B. In some implementations, this spacing function may be enhanced when particles of Pigment C are larger than particles of Pigment A and Pigment B. For example, the mean particle size of Pigment C may range between 2 to 15 micrometers. In some implementations, the mean particle size of Pigments C may be in the range of 3 to 8 micrometers. The pore volume of Pigment C may range between 0.5-2.0 millimeters per gram and the absorption (as measured using a standardized oil testing) may range between 80-300 grams for 100 grams of particles.

The image receiving layer also includes a polymeric binder that binds the pigments together and to the underlying layer. The polymeric binder directly influences the durability, weathering, moisture resistance and scratching resistance of the image receiving layer. To accomplish these goals, a water resistant polymeric binder is selected. The polymer binder can be any of a variety of polymeric materials, including those specified above with respect to the barrier layer. For example, the water resistant polymeric binder may have an acid number smaller than 40 or, alternatively, can be self-cross linked under heat. The polymeric binder in the image receiving layer is present in an amount sufficient to bind the inorganic pigments and pigments to barrier layers, and to meet the requirements of runability or durability. In one implementation, the binder is present in an amount ranging from about 5 to 35 parts based on 100 parts of inorganic pigments.

Other components, such as processing aids, like water retention agents, viscosity modifiers, and PH control agents may also be used in the imagine receiving layer. Other functional additives such as color hue adjuster (dyes), optical brightness agents, biocides can also be included in the image receiving layer.

The coat weight of the image receiving layer is selected based on a number of factors including image quality, processing constraints, and cost. An image receiving layer that is too thin will adversely reduce ink capacity and could result in printing image defects such as ink bleed or extend the ink dry time. An image receiving layer which is too thick may create coating quality issues and increase material cost. According to one embodiment, the coating weight of image receiving layer between 15 to 45 grams per square meter. For example, the coat weight may be from 20 to 35 grams per square meter.

Pressure Sensitive Adhesive Layer

A pressure sensitive adhesive layer may also be included in the media. The pressure sensitive adhesive layer is a thin layer of adhesive on the side of the media opposite the image receiving layer. The pressure sensitive adhesive layer bonds the media to a support structure such as a wall or other media support surface. The pressure sensitive adhesive layer may also allow the media to be repositioned.

The pressure sensitive adhesive layer may include a polyacrylate based polymer or copolymer that is applied as a solvent dispersion or an aqueous dispersion. The pressure sensitive adhesive layer may be applied using a variety of suitable on-line or off-line coating techniques.

Release Layer

A release layer is placed over the pressure sensitive adhesive layer to allow a backing sheet to be easily removed from the pressure sensitive adhesive layer. According to one example, the release layer may be formed from poly-silicone. The release layer may be applied in solvent or aqueous dispersion by an on-line or off-line coater.

Backing Sheet

According to one example, the backing sheet may be a wax coated paper to protect the pressure sensitive adhesive layer from being contaminated prior to usage. A variety of other backing sheet configurations can also be used.

Pre-Applied Water Active Adhesive Layer

A pre-applied water active adhesive layer becomes activated when exposed to water. The pre-applied water active adhesive layer may include water, an alkali, polyvinyl acetate-crotonic acid copolymer, a thickener, and a glycol. The pre-applied water active adhesive layer is activated and positioned over the desired support surface and then brought into contact with the support surface. As discussed above, the pre-applied water active adhesive layer may be activated by submerging the substrate in water.

Examples of Inkjet Media

Figure 2A:
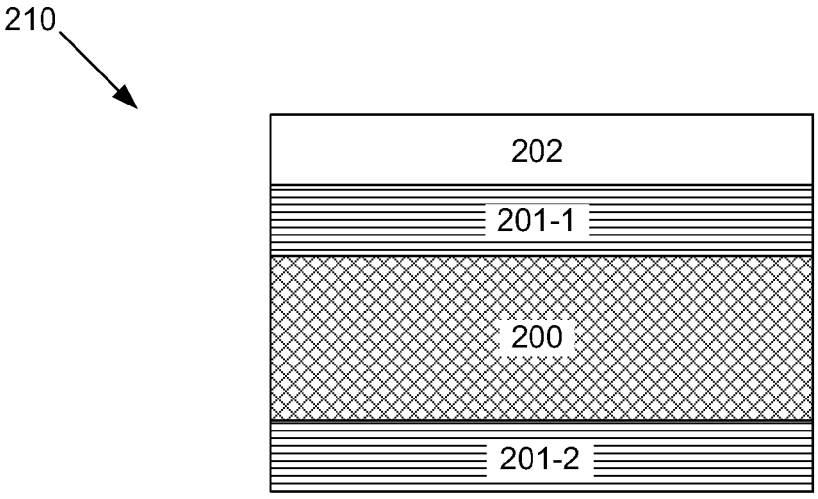
FIGS. 2A-2C are cross-sectional views of various illustrative inkjet media, according to one example of principles described herein.
Figure 2B:
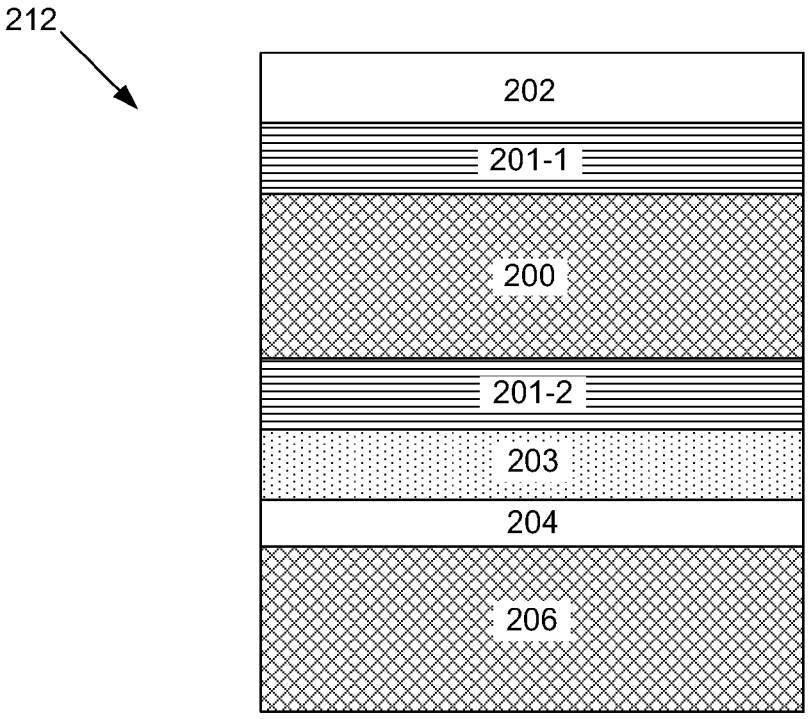
Figure 2C:
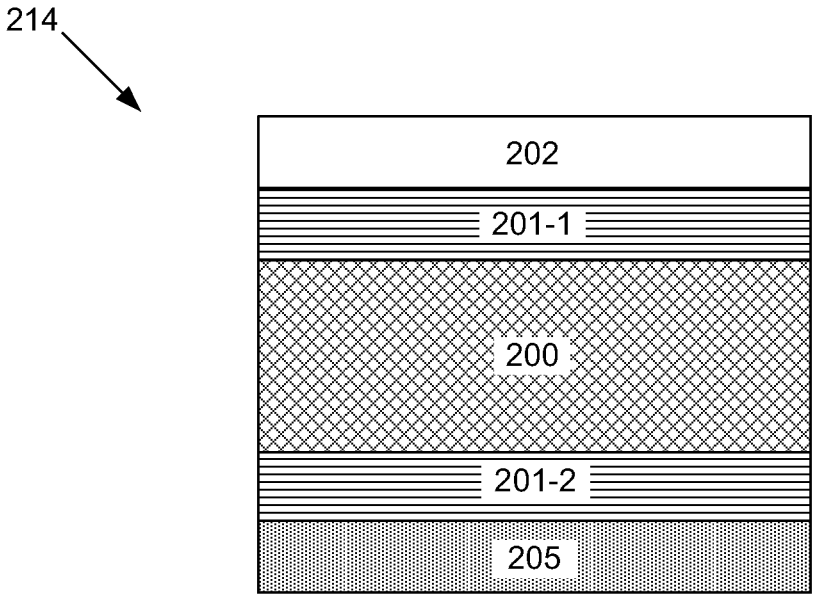

FIGS. 2A-2C are cross-sectional diagrams of illustrative inkjet media. The cross sectional diagrams are for purposes of illustration only and are not drawn to scale. Specifically, the thicknesses of the layers have been increased so that the layers are visible. The relative thicknesses of the layers are only approximate and are not to scale. The composition, structure and other information about the various layers is given above.

FIG. 2A is an illustrative inkjet media which includes a media substrate (200) with barrier layers (201-1, 201-2) on both its upper and lower surfaces. As discussed above, the media substrate (200) may include cellulose fibers, synthetic fibers, pigments, and resin. According to one illustrative example, the substrate includes cellulose fibers that are a combination of hardwood and softwood fibers with an average fiber length of approximately 0.5 to 3 millimeters. The ratio of hardwood to softwood can range from all hardwood fibers to all softwood fibers. According to one implementation, the weight ratio of hardwood to softwood fibers in the cellulose is between 30:100 and 70:100. The synthetic fibers may be polyolefin or other suitable fibers with a diameter of approximately 10-40 micrometers and a length of approximately 2-3 millimeters. The weight ratio of synthetic fibers to cellulose fibers is between 10:100 and 60:100.

As discussed above, a variety of pigments and resins can be also incorporated into the substrate. For example, up to 25% by weight of inorganic fillers, and up to 5% by weight of a moisture repelling agent can be incorporated into the substrate. A variety of other additives can also be incorporated. The substrate may have a weight per unit area of between 90 to 200 grams per square meter.

As discussed above, the barrier layers (201) are resin-rich pigment coating layers that reduce or prevent exterior moisture from penetrating the media substrate. For example, barrier layer may include polymer resin binders in amounts that are not less than 30% by weight of the total pigment fillers in the barrier layers. There are a wide variety of resin compositions which can be used in the barrier layer. For example, the resin may be polyacrylic latex with low hydrophobicity and an acid number between 20-70. The low acid number contributes improves the hydrophobic character of the barrier layers. The barrier layers may have a weight per unit area of approximately 5 to 25 grams per square meter.

The ink receiving layer (202) is deposited on one or both sides of the media (170). In the example shown in FIG. 2A, the ink receiving layer (202) is only deposited on the upper surface of the media (170). The ink receiving layer (202) may include at least three different types of pigments and a polymeric binder. The first type of pigment is selected to produce a smooth and dense coating layer that provides desirable physical properties of a printing media such as smoothness, opacity, whiteness and brightness. The second type of pigment provides the capacity for aqueous ink absorption. A water resistant polymeric binder binds the pigments together and to the underlying layer. The polymeric binder may be any of a variety of polymeric materials binder which has an acid number smaller than 40 to 70, alternatively, can be self-cross linked under heat. The amount of the binder used in the image receiving layer is no less than 30% weight of total inorganic pigments contained in the image receiving layer. The ink receiving layer may have a weight per unit area of between 25 to 35 grams per square meter.

The media (210) can be used for a variety of purposes, including wall paper or signage. Because the media (210) does not include an adhesive layer on the back surface, adhesive may be separately applied during installation or other fastening techniques may be used.

FIG. 2B is a cross sectional diagram of an illustrative inkjet media (212) which includes a substrate layer (200), barrier layers (201) and an image receiving layer (202) as described above. Additional layers are disposed on the lower or back surface of the media (212). These additional layers include a pressure sensitive adhesive layer (203), a release layer (204) and a backing sheet (206). The pressure sensitive adhesive layer (203) is bonded directly to the barrier layer (203). As discussed above, the release layer (204) allows the backing sheet (206) to be peeled from the pressure sensitive adhesive layer (203) prior to installation of the media (212). The release layer (204) is removed with the backing sheet (206).

The media in FIG. 2B is configured to be printed on the upper surface containing the image receiving layer (202) and then installed by removing the backing sheet (206) and release layer (204). The pressure sensitive adhesive layer (203) can then be used to hold the media (212) in the desired location.

FIG. 2C is a cross sectional diagram of an illustrative inkjet media (214) which includes the substrate (200), barrier (201) and image receiving (202) layers described above. An additional water activated adhesive layer (205) is bonded directly to the lower barrier layer (201-2). Ink is deposited on the image receiving layer (202) to form the desired image. The media (214) is then dipped in water or water is otherwise deposited on the water active adhesive layer (205). This activates the adhesive layer (205), which can then be used to hold the media (214) in place.

Examples of Product Construction & Formulation

Two illustrative media samples, Media A and Media B, were constructed using the principles and formulations described above. The performance of the media samples were compared against a standard media sample, media C.

Media A was made in a pilot paper machine with a pulp which included 70% cellulose fibers and 30% synthetic fibers. The cellulose fiber included 70% hardwood and 30% softwood fibers by weight. The synthetic fibers were a mixture of high density polyethylene (HDPE) and low density polyethylene (LDPE) with approximately a 1:1 ratio. About 12% by weight of a pigment composition was included in the substrate. In this example, the pigment composition included 90% calcium carbonate and 10% titanium dioxide. About 5% by weight of polyethylene wax dispersion was included in the substrate as a moisture repelling agent. About 8 to 10% by weight of an acrylic emulsion was used as the binder. Although a wide variety of additional additives may be included, no other wet strengthening agent was used in this example.

Media B was made in a pilot paper machine with the pulp that included 70% cellulose fibers and 30% synthetic fibers. The cellulose fiber included 70% hardwood and 30% softwood fibers by weight. As discussed above with respect to Media A, the synthetic fibers were a mixture of high density polyethylene (HDPE) and low density polyethylene (LDPE) with approximately a 1:1 ratio. About 12% by weight of a pigment composition (90% calcium carbonate and 10% titanium dioxide) was included in the substrate. The substrate web was first dried and then saturated with a polyacrylic resin during surface sizing process, and dried again. Media B has approximately the same basis weight and the caliper as Media A.

Media C is the control media and was made without synthetic fibers or resin binders. In this example, media C was made in a pilot paper machine with the pulp which included 100% cellulose fiber made of 70% hardwood and 30% softwood. About 12% by weight of a pigment composition (90% calcium carbonate and 10% titanium dioxide) was included in the substrate. The substrate web was first dried and then surface sized using a oxidized starch, and dried again. Media C has approximately the same basis weight and the caliper as media A and media B.

Media A, B and C were each coated on both sides with the same barrier layer composition. The barrier layer formulation included 64% by weight of ground calcium carbonate and 35% by weight of polyacrylic latex. The coating solution was applied on the substrate web by a rod metered paper coater.

Media A, B and C were each coated on one side with the same image receiving layer composition. Image receiving layer included inorganic pigments made from a precipitated calcium carbonate with acicular aragonite crystals, a calcinated clay, and a precipitated silica and/or a mixture of silica gels. A polymeric binder with styrene-acrylic polymers was included in the image receiving layer at 35-40 parts per 100 parts of the inorganic pigments. The coating solution was applied to each of the media using a rod metered paper coater.

Test Results

Chart 1 describes results of tests to measure media expansion due to moisture absorption for each of Media A, B and C. As discussed above, media expansion due to absorption of moisture is undesirable. In a first test, media A, B and C where placed in an environmental chamber at 30° C. and 80% relative humidity for 3 days. The expansion of the media was then measured. As shown in the first column of Chart 1, Media A expanded 0.5-0.8% and Media B expanded 1.5-2.0%. This result indicates that polyethylene wax dispersion and acrylic emulsion in the substrate layer of Media A were more effective excluding moisture and maintaining dimensionally stable than the resin impregnation used in the substrate layer of Media B. Media C was used as a control and had a dimension change of 4-7%. The test results show that both Media A and Media B are dramatically more resistant to high humidity than Media C.

A second test involved immersing the media in water for 3 minutes. This simulated the activation of a water activated adhesive layer on the back of a wall paper media. Media A again showed the least expansion with 0.8-1.3% expansion. Media B showed more than twice the expansion of Media A with 2.0-4.0% expansion. Media C was damaged by the immersion in water and its expansion could not be measured.

CHART 1

| | 30 C./80RH storage | Immerse into water for 3 min. |
|---|---|---|
| Media A | 0.5-0.8% | 0.8-1.3% |
| Media B | 1.5-2.0% | 2.0-4.0% |
| Media C (comparative) | 4-7% | Damaged, not measurable |

Chart 2 shows results of three tests which were used to compare image quality between Media A and a commercial large format media, DURAGRAPHIX wall paper. The first test was an 8 point Gamut test which measures the vividness of a set of colors printed on the substrate, with greater vividness being indicated by higher measured values. Identical inks were deposited on both Media A and the DURAGRAPHIX wall paper using the same printer. In all the tests shown in Chart 2, HP aqueous inkjet inks were dispensed onto the substrates using an HP Z3200 printer. As shown in the second column of the chart, Media A has an 8-point Gamut value of 417,405 while the DURAGRAPHIX wall paper exhibited an 8-point Gamut value of only 257,485. This clearly demonstrates that the printed ink was more vivid on Media A than on the DURAGRAPHIX paper.

The next test measured the L*min of black ink deposited on the substrates, with lower values indicating more desirable and darker tones. The black ink deposited on Media A showed an L*min of 15.19 while black ink deposited on the DURAGRAPHIX wall paper showed a L*min of 17.86.

A third test involved measuring black ink run after immersion into water. Because wall papers can be purposefully exposed to water during installation and are exposed to environmental water and humidity after installation, it is highly desirable that the ink does not run due to water exposure. In this case, the black ink deposited on Media A did not exhibit ink running follow immersion into water. Black ink deposited on the DURAGRAPHIX wall paper showed slight black ink running after immersion into water.

CHART 2

| | 8-point Gamut | L*min | Ink running after immersion into water |
|---|---|---|---|
| Formulation on Media A | 417405 | 15.19 | No ink running |
| DURAGRAPHIX (commercial wall paper) | 257485 | 17.86 | Slight black ink running |

The examples given above are illustrative. A variety of other compositions and structures could be used. For example, the barrier layers may not be identical. In some implementations, only one barrier layer is used. In other implementations, a first barrier layer composition may underlie the image receiving layer and a second and different barrier layer composition may used on the opposite surface of the substrate.

The illustrative inkjet media described above have increased water resistance, dimensional stability and enhanced image quality. In general, the illustrative inkjet media includes a media substrate, barrier layers, and an image receiving layer. In some examples, the illustrative inkjet media may include a water active adhesive layer or a pressure sensitive adhesive layer.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. An inkjet media comprising:

a substrate layer comprising cellulose fibers, synthetic fibers, and a polymeric binder; and a barrier layer disposed on at least one side of the substrate layer the barrier layer comprising pigment fillers and at least 30% by weight of a polymer resin.

2. The inkjet media of claim 1, in which the polymer resin has an acid number between 20-70.

3. The inkjet media of claim 1, in which the cellulose fibers comprise hardwood fibers and softwood fibers, in which a weight ratio of hardwood fibers to softwood fibers in the cellulose is between 30:100 and 70:100.

4. The inkjet media of claim 1, in which the synthetic fibers comprise fibers with a diameter of between 10-40 micrometers and average fiber length of 2-3 millimeters.

5. The inkjet media of claim 4, in which the synthetic fibers are polyolefin fibers with a crystalline structure and a melting point range of 100-140 C.

6. The inkjet media of claim 1, in which a weight ratio of synthetic fibers to cellulose fibers is between 10:100 and 60:100.

7. The inkjet media of claim 1, further comprising an image receiving layer disposed on the barrier layer, the image receiving layer comprising a first pigment type and a second pigment type, the first pigment type comprising particles with a size between 0.5 to 3.0 micrometers and the second pigment type comprising particles with a size between 5-15 micrometers, a pore volume between 1.5-3 milliliters per gram, and an absorption capacity of between 200-400 grams per 100 grams of particles.

8. The inkjet media of claim 7, in which the image receiving layer further comprises a polymer binder with an acid number smaller than 40, in which an amount of polymer binder in the image receiving layer is at least 30% of a total weight of pigments in the image receiving layer.

9. The inkjet media of claim 8, in which the image receiving layer comprises an amount of the polymer binder between 35-50 parts by weight of the total weight of pigments in the image receiving layer.

10. The inkjet media of claim 7, in which the image receiving layer comprises a polymeric binder which is self-cross linked under heat.

11. The inkjet media of claim 1, further comprising a pressure sensitive release layer bonded on the barrier layer and a release layer and backing sheet disposed on the pressure sensitive release layer.

12. The inkjet media of claim 1, further comprising a water activated adhesive layer disposed on the barrier layer on a side of the inkjet media opposite an image receiving layer.

13. The inkjet media of claim 1, in which the synthetic fibers are a mixture of high density polyethylene fibers and low density polyethylene fibers.

14. An inkjet media comprising:

a substrate layer comprising:

cellulose fibers, in which hardwood fibers comprise between 30 to 70 percent by weight of the cellulose fibers;

polyolefin fibers having a diameter of between 10-40 micrometers, average fiber length of 2-3 millimeters, a crystalline structure, and a melting point range of 100-140 C, the polyolefin fibers being included in the substrate layer in the amount of between 10 to 60 percent weight of the cellulose fibers; and a polymeric binder; and a barrier layer disposed on at least one side of the substrate layer, the barrier layer comprising pigment fillers and a polymer resin having an acid number between 20-70; and an image receiving layer disposed on the barrier layer, the image receiving layer comprising a first pigment type and a second pigment type, the first pigment type comprising particles with a size between 0.5 to 3.0 micrometers and the second pigment type comprising particles with a size between 5-15 micrometers, a pore volume between 1.5-3 milliliters per gram, and an absorption capacity of between 200-400 grams per 100 grams of particles.

15. A media sheet comprising:

a substrate layer comprising:

fiber comprising approximately 70% cellulose fibers and 30% synthetic fibers, in which the cellulose fiber comprises approximately 70% hardwood and 30% softwood fibers by weight and the synthetic fibers comprise a mixture of high density polyethylene fibers and low density polyethylene fibers in a 1:1 ratio;

a pigment composition comprising calcium carbonate and titanium oxide, the pigment composition being about 12% by weight of the cellulose and synthetic fibers;

a polyethylene wax dispersion, the amount of polyethylene wax dispersion being about 5% by weight of the cellulose and synthetic fibers; and an acrylic emulsion binder, the acrylic emulsion binder being between 8-10% by weight of the cellulose and synthetic fibers; and an image receiving layer.

16. The media sheet of claim 15, in which the synthetic fibers comprise fibers with a diameter of between 10-40 micrometers and average fiber length of 2-3 millimeters.

17. The media sheet of claim 15, in which the image receiving layer comprises a first pigment type and a second pigment type, the first pigment type comprising particles with a size between 0.5 to 3.0 micrometers and the second pigment type comprising particles with a size between 5-15 micrometers, a pore volume between 1.5-3 milliliters per gram, and an absorption capacity of between 200-400 grams per 100 grams of particles.

* * * * *